US005086380A

United States Patent [19]

Hedner, Jr.

[11] Patent Number: 5,086,380

[45] Date of Patent: Feb. 4, 1992

[54] DECORATIVE APPARATUS

[76] Inventor: Carleton R. Hedner, Jr., 489 Creek Rd., Doylestown, Pa. 18901

[21] Appl. No.: 564,532

[22] Filed: Aug. 6, 1990

[51] Int. Cl.[5] ..... F21L 19/00

[52] U.S. Cl. ..... 362/161; 362/162; 431/291; 431/295; 431/32

[58] Field of Search ..... 431/291, 295, 320; 362/161, 162

[56] References Cited

U.S. PATENT DOCUMENTS 4,384,847 5/1983 Schirneker ..... 362/161

4,557,687 12/1985 Schirneker ..... 431/295

*Primary Examiner*—Carroll B. Dority

*Attorney, Agent, or Firm*—Rene A. Kuypers

[57] ABSTRACT

A decorator device for adding atmosphere to various rooms of a home. The device comprises a glass bowl filled with a liquid and which may be adapted to receive long stem candle holders and is designed for placement upon a fireplace grate or alternatively, as a centerpiece or display for a tabel. Floatable candles are positioned within the candle holders to generate an aura of relative warmth to an observer within a room.

14 Claims, 2 Drawing Sheets

DECORATIVE APPARATUS

BACKGROUND OF THE INVENTION

It has been observed by certain home decorators and those with real estate interests that present day fireplaces are unattractive locations in a home's decor during the off-season, such as the late spring and summer. The reason that observant decorators have focused upon the unused home fireplace is that the fireplace cavity during the non-seasonal time period, lasting for a period of approximately seven months, presents an appearance of a darkened cavity which is inherently unattractive.

However, despite the limited utilization of a fireplace whose seasonal use is about five months, its relatively high cost, which may range from thirty-five hundred to five thousand dollars, as well as its well recognized reputation as an inefficient source of heat, nevertheless, it is still one of the most popular amenities of the modern day home purchaser.

It has been observed that most homeowners, despite the large investment in their home fireplaces, do very little with this amenity during the months of non-use. However, it has been noted that a certain percentage of owners use Birch logs, dried or artificial flower arrangements, or similar substitutes to augment the darkened space within an unused fireplace cavity.

Although the above discussed fireplace enhancers are considered adequate in some repects they are nevertheless not deemed to be entirely satisfactory since they do not radiate an aura that generates a glow similar to that produced by the flames of a fire.

Certain patents such as U.S. Pat. Nos. Des. 245,936(Roush), 263,083(LeVan) and 266,365(Rosenbaum) disclose various candle floats and float holders but they are not germane to the synergistic effect produced and proposed in the instant application.

Accordingly, the present invention has been designed to emulate the feeling of warmth emanating from a real fireplace during non-seasonal periods. The design is found particularly useful in homes during festive occasions such as special events when guests are present or parties are being given.

SUMMARY OF THE INVENTION

A room enhancifier is disclosed for placement in a fireplace cavity during periods of non-use, or as a table centerpiece as well as a decorative display in any room of a residence. The enhancifier comprises a glass bowl that is suitably designed for placement upon a fireplace grate or andiron.

The bowl is adapted to receive an insert for receiving a plurality of stems which extend above the top level of the bowl. The top of each stem carries a cup which is sized to hold a candle.

In an operative state the bowl, which is filled with a colored water, causes the candles when lit to cast reflections off the water and bowl. These reflections together with the flickering light emanating from the candles fill the darkened and empty fireplace pit to provide a sense of warmth and atmosphere. This type of atmosphere materially enhances the overall usefulness of the fireplace as a high cost amenity without substantial cost and a minimum of effort.

Although the invention has been described in combination with a fireplace, it should nevertheless be understood that it can also be utilized in a more conventional setting as for a centerpiece for a dining room table or as a room decoration similar to or as a substitute for a floral display. In such a format, the use may be varied and a function of the imagination of the user.

It is therefore an object of the invention to provide a new and useful decorative item.

It is still an additional object of the invention to enhance the utilization of the fireplace during non-seasonal periods.

It is still a further object of the invention to create an artifact that is pleasing in appearance and which is useful as a decorative item.

DESCRIPTION OF THE PREFERRED EMBODIMENTS

Figure 1:
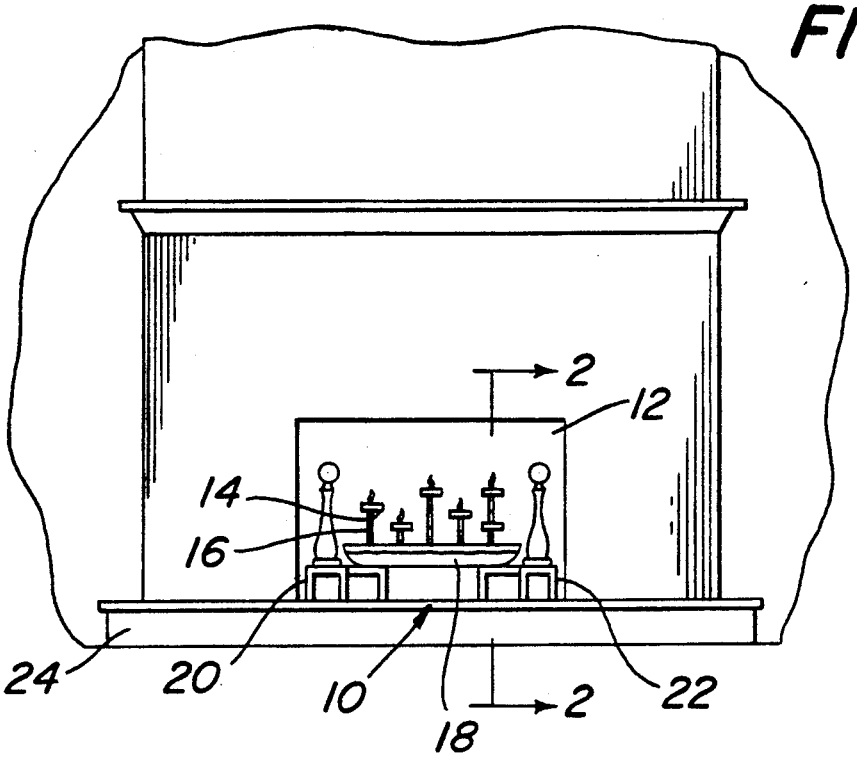
FIG. 1 is a front elevation view of a fireplace in which the candle lit bowl is placed for positioning upon a grate or andiron.

FIG. 1, which depicts the preferred embodiment of the invention, illustrates in a front elevation view the subject home enhancifier 10 within a fireplace cavity 12. The enhancifier 10 is deemed to be a decorative apparatus which is intended to be placed in the cavity 12 when it is in a darkened condition such as the off season or during periods of non-use. The enhancifier 10 is intended to emit a soft flickering glow or aura by way of a plurality of lit candles that fill the darkened cavity 12 and reflect off of the component parts of the apparatus.

The candles are positioned at various heights within bowls 14 and are floatable in a liquid medium retained within the bowls. The bowls 14 are elevated at different heights by slender stems 16.

The flickering light emanating from the candles project against the walls of the cavity 12 as well as projecting downwardly through the bowls 14 into the oblong shaped bowl 18 which is filled with a liquid medium such as colored water. The liquid medium within the bowls 14 may be identical to the medium within the oblong container 18. The bowl 18 is designed with a base configuration for ease of placement upon certain fireplace utensils including the andirons 20, 22 or a grate (not shown) which secures the bowl and prevents easy separation from the utensil. The bottom of the bowl 18 may include projections to assure that it will not be inadvertently moved from the andirons 20, 22 and its contents spilled.

The oblong container 18 which is preferably made of glass is designed to accommodate various size fireplace cavities; therefore, in a large sized embodiment it may be 24 to 26 inches in length, 18 inches in width and 3 to 5 inches in depth. In a medium container entity the dimensions are approximately 20 to 24 inches in length, 16 inches in width with a depth dimension of 3 to 5 inches; and in a small container, its dimensions are approximately 16 inches in length, 8 inches in width and 3 to 5 inches in depth.

It is understood that the andirons 20, 22 are located on the fireplace hearth which in some residences are raised off of the floor; in addition, the grate or andirons 20, 22 are raised approximately a foot above the hearth so that good eye contact is encounted with the bowl 10 when seated or standing in a room. Therefore, through the eyes of the beholder one is able to focus upon the flickering light formed by the floatable candles within bowls 14, the liquid medium of bowl 18 as well as the reflections from the stems 16 as well as the other components of the apparatus 10. The bowls 14, 18 and the stems 16 are made of glass, crystal, plexiglass or other suitable materials that will transmit and reflect light in a multitude of directions.

Figure 2:
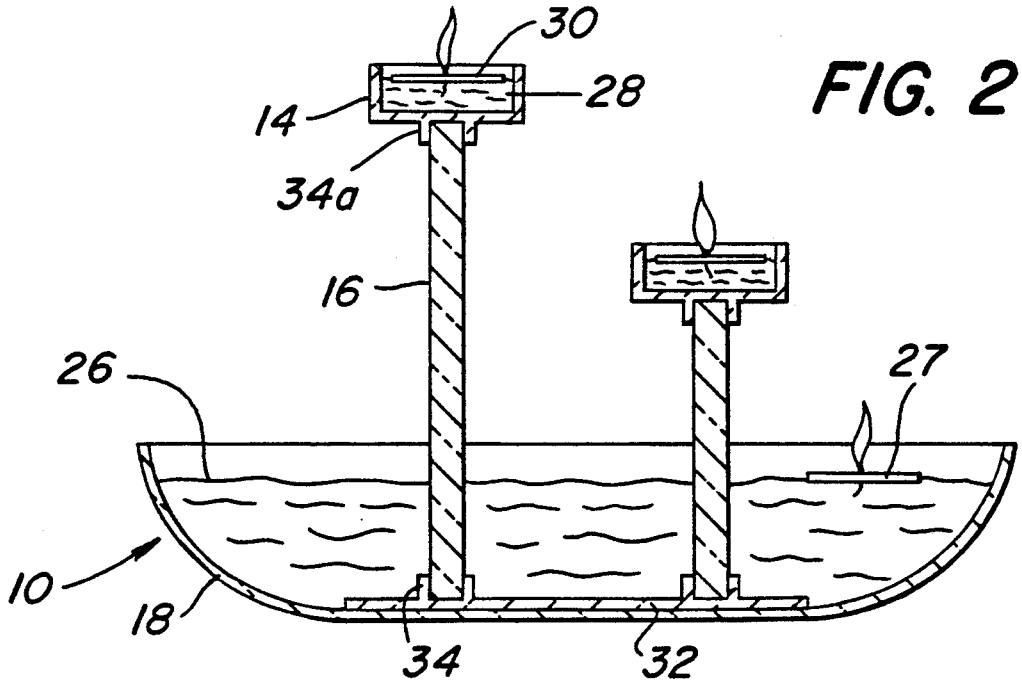
FIG. 2 is a sectional view taken along the line 2—2 of the decorative bowl of FIG. 1 and depicts the candle bearing stems positioned upon an insert within a liquid medium.

The sectional view of FIG. 2 graphically depicts the enhancifier 10 of FIG. 1 in greater detail. The oblong bowl 18 is provided with a base fitting insert 32 which is weighted sufficiently to remain along the bottom of the bowl 18. The base insert 32 includes a plurality of bosses 34 whose internal diameter may receive and hold the stem 16 with a snug type fit. The small diameter stems 16 extend above the liquid medium 26 such as colored water and may be varied in height from a neighboring stem as is readily observable.

There are small bowls 14 located atop the respective stems 16 which may be readily attached and detached during the assembly process. The bowls 14 are employed to retain another liquid medium 28 which may be of similar color and quality as the colored water 26 contained in bowl 18. On top of the surfaces of the colored water 28 are suspended floatable candles 30. The floatable candles 30 are self contained units that hold a combustible oil consisting of candle lamp oil which is 99% paraffin based in combination with a wick. In such an arrangement, the paraffin oil may be used in the floatable containers revealed in the prior cited patents. The floatable candles 30 may also be made of wax.

In another embodiment of the invention, the candle 27 may be simply floated upon the colored water 26 either alone, with other floatable candles, or in combination with the floating candles 30 within the bowls 14.

In operation when the floating candles 30 and/or candle 27 is lit, the generated candle light not only projects against the walls of the fireplace cavity 12 in FIG. 1 and into the room but in addition, the light strikes the liquid mediums 26, 28, the glass stems 16, the glass bowls 14, 18 to produce a synergistic light transmission and reflective action. This action materially enhances the darkness prevalent within the unused fireplace cavity 12 and markedly improves the appearance and ambience of a room.

The present apparatus 10 while it has been described with respect to a fireplace setting, it may nevertheless also find use as a decorative or display item for a table during festive or holiday occasions. Although the bowl 18 has been previously described having a particular external base arrangement which will secure the enhancifier apparatus 10 to a fireplace grate or andirons 20, 22, such a bottom design does not detract from its use in a simple decorative setting as for example in a residential dining room.

Figure 3:
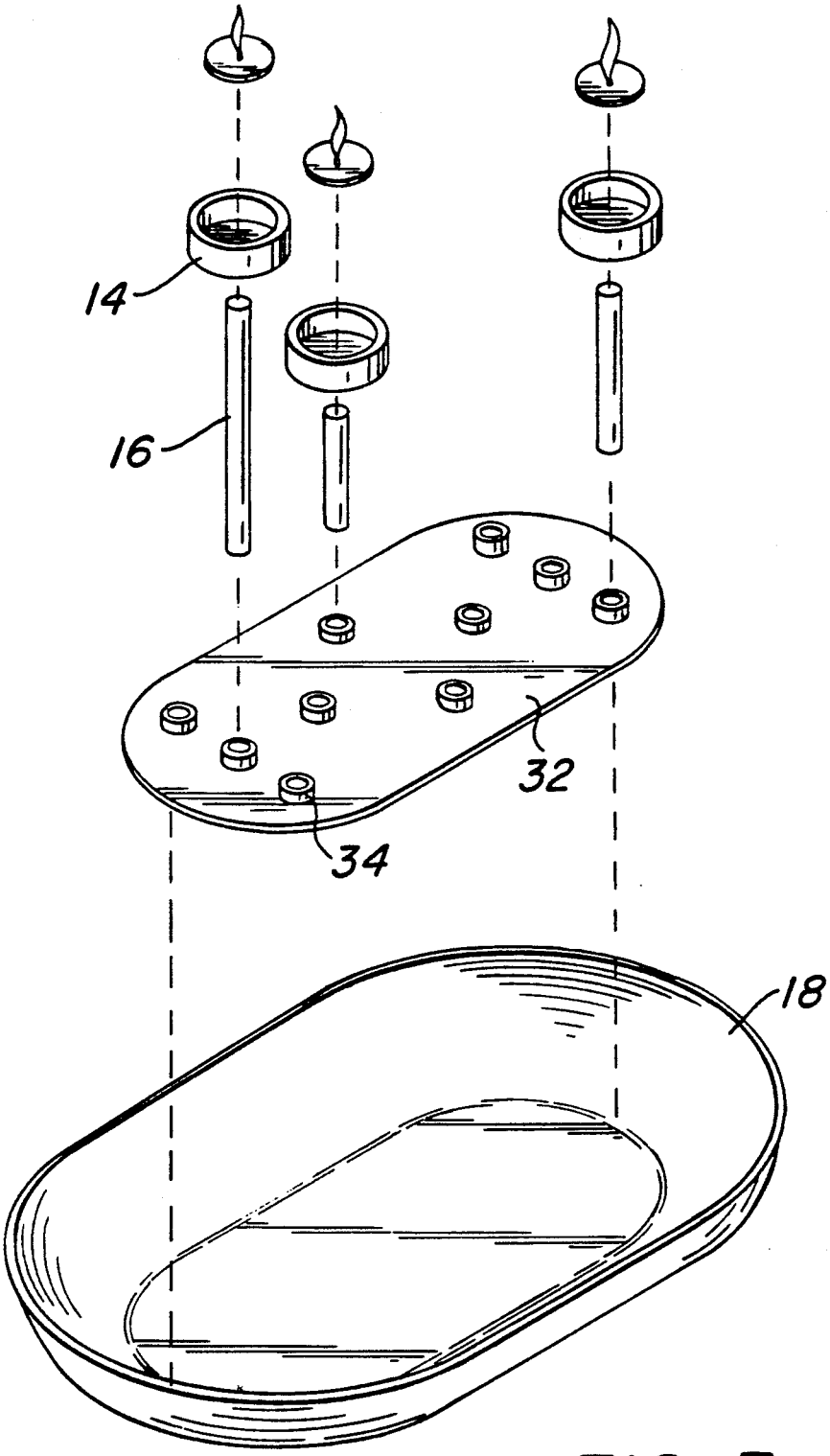
FIG. 3 is an exploded isometric view depicting the positioning and interaction of the various parts in the invention apparatus.

The exploded view of FIG. 3 illustrates the component parts and their interaction with one another in a complete assembly. The oblong container 18 shows the relationship of its inner base configuration with the oblong insert 32 which includes the plurality of bosses 34. The respective bosses 34 are adapted to receive one end of the slender stem 16; the other end of the stem 16 is detachably connected to the bowls 14 by techniques well known to those skilled in the art such as by snug fitting bosses 34*a*. Floatable candles 30 which are smaller in diameter than the bowls 14 are illustrated as being placed therein.

This invention has been described by reference to precise embodiments but it will be appreciated by those skilled in the art that the invention is subject to various modifications and to the extent that those modifications would be obvious to one of ordinary skill, they are considered as being within the scope of the appended claims.

What is claimed is:

1. A decorative apparatus comprising:

(a) an oblong container means for retaining and displaying a liquid medium;

(b) an insert means located within said container means, (c) said insert means comprising a base having a plurality of retention means;

(d) a plurality of means extending above said liquid medium and maintained in an upright position by being respectively inserted in one said retention means;

(e) a bowl means located upon the top of said plurality of means extending above said liquid medium;

(f) candle means located within said bowl means, (g) whereby the burning of said candle means causes a reflection of light upon said liquid medium, bowls means and extending means to provide atmosphere to a location where said container means is located.

2. A decorative apparatus in accordance with claim 1 wherein said container, bowl and extending means are made of glass.

3. A decorative apparatus in accordance with claim 2 wherein said elongated container is shaped for positioning and resting upon a fireplace grate or alternatively, andirons.

4. A decorative apparatus in accordance with claim 2 wherein said insert means is adapted to conform with the shape of said oblong shaped container.

5. A decorative apparatus in accordance with claim 1 wherein said retention means includes a plurality of cylindrical bosses for receiving said candle means.

6. A decorative apparatus in accordance with claim 1 wherein said means extending above said liquid medium has a relatively long and slender stem.

7. A decorative apparatus in accordance with claim 1 wherein said liquid medium comprises colored water.

8. A decorative apparatus in accordance with claim 1 wherein said candle means is adapted to float in a liquid medium within said bowl means.

9. A decorative apparatus in accordance with claim 1 wherein said candle means comprises a combustible medium retained within said bowl means in which a wick is placed through a float means.

10. A decorative apparatus in accordance with claim 9 wherein said float means comprises a member for retaining a paraffin based lamp oil from which said wick extends in an upward direction.

11. A decorative apparatus in accordance with claim 1 wherein said bowl means is detachable from said means extending above the liquid medium.

12. A decorative apparatus in accordance with claim 1 wherein said container, bowl and extending means is made of plexiglass.

13. A decorative apparatus comprising:

(a) an oblong container means for retaining and displaying a first liquid medium;

(b) an insert means located within said container means, (c) said insert means comprising a base having a plurality of retention means;

(d) a plurality of means extending above said liquid medium and maintained in an upright position by being respectively inserted in one said retention means;

(e) a bowl means located upon the top of said plurality of extending means;

(f) floatable candle means located within said bowl means upon a second liquid medium;

(g) floatable candle means located upon said first liquid medium, (h) whereby the burning of said floatable candle means causes a plurality of light reflections to impinge upon said first and second liquid mediums, bowl means and extending means to produce an atmosphere within a room environment.

14. A decorative apparatus in accordance with claim 13 wherein said oblong container means is adapted for use on fireplace grates or alternatively andirons.

* * * * *